US007198158B2

(12) United States Patent
Kao

(10) Patent No.: US 7,198,158 B2
(45) Date of Patent: Apr. 3, 2007

(54) TOOL SUSPENSION DEVICE

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 181 days.

(21) Appl. No.: 11/005,078

(22) Filed: Dec. 7, 2004

(65) Prior Publication Data

US 2006/0118499 A1 Jun. 8, 2006

(51) Int. Cl.
*A47F 7/00* (2006.01)

(52) U.S. Cl. ..... 211/70.6

(58) Field of Classification Search ..... 211/70.6; 206/378, 349; 248/354.7
See application file for complete search history.

(56) References Cited

U.S. PATENT DOCUMENTS 4,343,450 A * 8/1982 Anderson ..... 248/454
5,154,508 A * 10/1992 Ahroni ..... 362/655
5,645,177 A * 7/1997 Lin ..... 211/70.6
5,957,568 A * 9/1999 Byers ..... 362/235
6,092,655 A * 7/2000 Ernst ..... 206/378
6,095,329 A * 8/2000 Kao ..... 206/378
6,250,466 B1 * 6/2001 Ernst ..... 206/378
6,386,363 B1 * 5/2002 Huang ..... 206/378
6,637,605 B2 * 10/2003 Ernst ..... 211/70.6

* cited by examiner

*Primary Examiner*—Jennifer E. Novosad
(74) *Attorney, Agent, or Firm*—Posz Law Group, PLC; R. Eugene Varndell, Jr.

(57) ABSTRACT

A tool suspension device has a bracket and multiple holders. The bracket has an upper rail, a lower rail and two mounting holes. Each holder slidably clamps onto the bracket and has a clamp and a support arm. The clamp has an upper groove and a lower groove that clamp respectively on the upper and lower rail. The support arm is formed on and extends out from the clamp and has two sides, a distal end, optional jaws and an optional lip. The jaw on one holder faces a jaw on an adjacent holder to hold a tool between the jaws. The lip is formed on the distal end of the arm to keep a hanging tool from slipping off the arm.

2 Claims, 6 Drawing Sheets

TOOL SUSPENSION DEVICE

BACKGROUND OF THE INVENTION

1. Field of the Invention

The present invention relates to a suspension rack, especially to a suspension device used to hold and display tools.

2. Description of the Prior Arts

With reference to FIGS. 5 and 6, conventional perfboards (70) with multiple holes (71) are often mounted on wall in workshops or stores to hold and display tools. A conventional tool suspension device comprises a bracket (40) and multiple resilient elements (50). The bracket (40) is mounted securely on the perfboard (70) and has two ends, a longitudinal slot (41) and two mounting holes (42). The longitudinal slot (41) is formed in the bracket (40). The two mounting holes (42) are formed in the bracket (40) near opposite ends, and two screws, pegs or the like pass respectively through the mounting holes (42) and the holes (71) in the perfboard (70) to mount the bracket (40) on the perfboard (70). The resilient elements (50) are mounted slidably against each other in the longitudinal slot (41). A tool (60) is mounted on the conventional tool suspension device by pressing the tool (60) between adjacent resilient elements (50). The conventional tool suspension device uses elasticity to hold tools.

Because the resilient elements (50) press against each other, restitution forces generated by pressing multiple tools between different adjacent resilient elements (50) are cumulative, which may result in large tools easily dislodging from the conventional tool suspension device or the number of tools mounted on the conventional tool suspension device being limited. Therefore the type, size and quantity of tools held by the conventional tool suspension device is limited.

To overcome the shortcomings, the present invention provides an improved tool suspension device to mitigate or obviate the aforementioned problems.

SUMMARY OF THE INVENTION

The main objective of the present invention is to provide an improved tool suspension device that can hold more and different kinds of tools in position on the tool suspension device.

A tool suspension device in accordance with the present invention has a bracket and multiple holders. The bracket can be mounted on a perfboard, a flat surface or vertical supports and has an upper rail, a lower rail, two mounting holes and optional ratchets. The ratchets are formed respectively on the upper and lower rails and have multiple notches. Each holder slidably clamps onto the bracket and has a clamp and a support arm. The clamp has an upper groove, a lower groove and optional pawls. The upper and lower grooves slide and clamp respectively on the upper and lower rail. The pawl on the holder engages a notch on the ratchet to hold the holder in position. The support arm is formed on and extends out from the clamp and has two sides, a distal end, optional jaws and an optional lip. The jaw on one holder faces a jaw on an adjacent holder to hold a tool between the jaws. The lip is formed on the distal end of the arm to keep a hanging tool from slipping off the arm.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
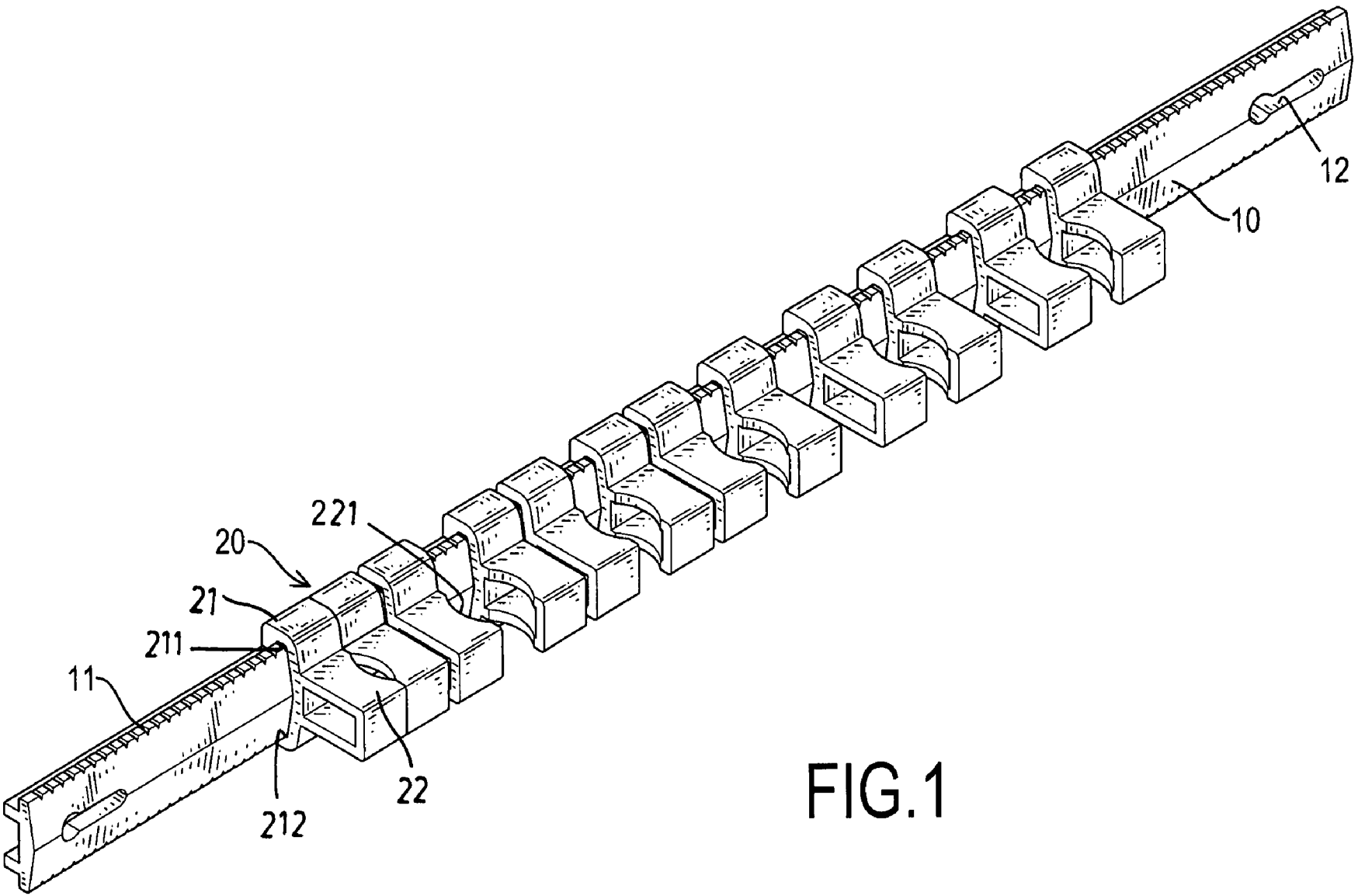
FIG. 1 is a perspective view of a tool suspension device in accordance with the present invention.

With reference to FIG. 1, a tool suspension device in accordance with the present invention comprises a bracket (10) and multiple holders (20).

The bracket (10) has two ends, an upper rail, a lower rail, two mounting holes (12) and optional ratchets (11). The mounting holes (12) are formed through the bracket (10) respectively near the two ends. The ratchets (11) are formed respectively on the upper rail and the lower rail and have multiple notches.

Each holder (20) slidably clamps onto the bracket (10) and has a clamp (21) and a support arm (22).

Figure 2:
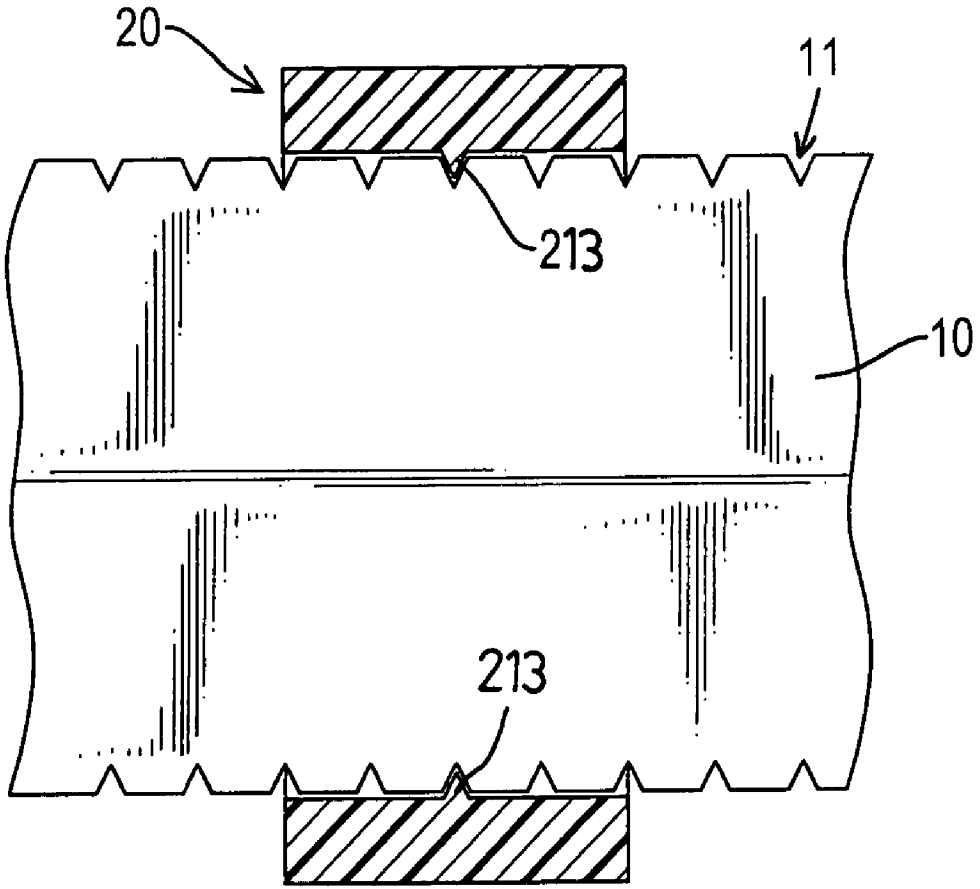
FIG. 2 is a front view in partial section of a holder and a bracket of the tool suspension device in FIG. 1.

With further reference to FIG. 2, the clamp (21) has an inside surface, an outside surface, an upper groove (211), a lower groove (212) and optional pawls (213). The upper and lower grooves (211, 212) are formed on the inside surface and slide and clamp respectively on the upper and lower rail. The pawls (213) are formed respectively in the grooves (211, 212) and correspond to and engage notches in the corresponding ratchets (11).

Figure 4:
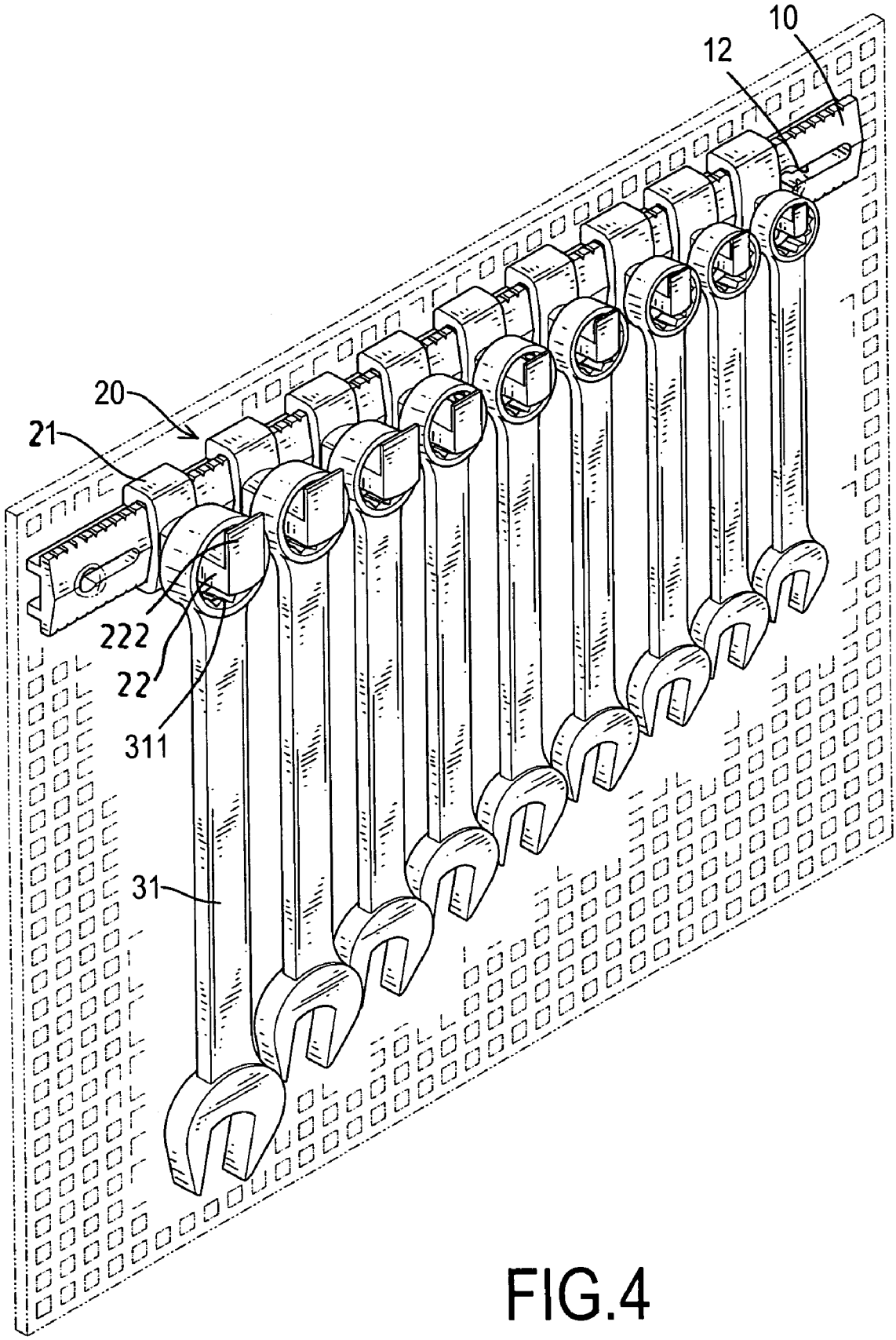
FIG. 4 is an operational perspective view of another embodiment of a tool suspension device in accordance with the present invention mounted on a perfboard.
Figure 5:
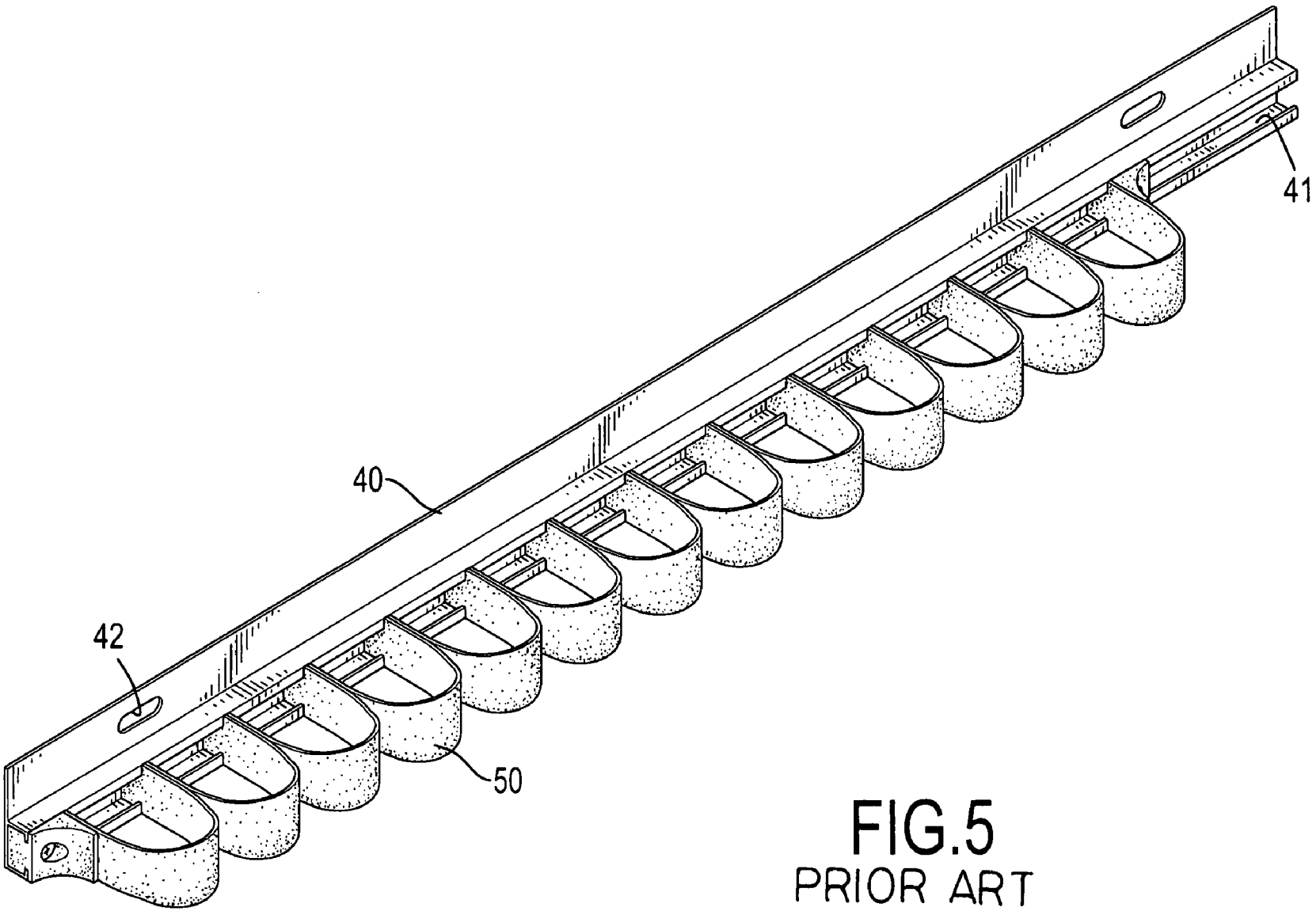
FIG.5 PRIOR ART
FIG. 5 is a perspective view of a conventional tool suspension device in accordance with the prior art.
Figure 6:
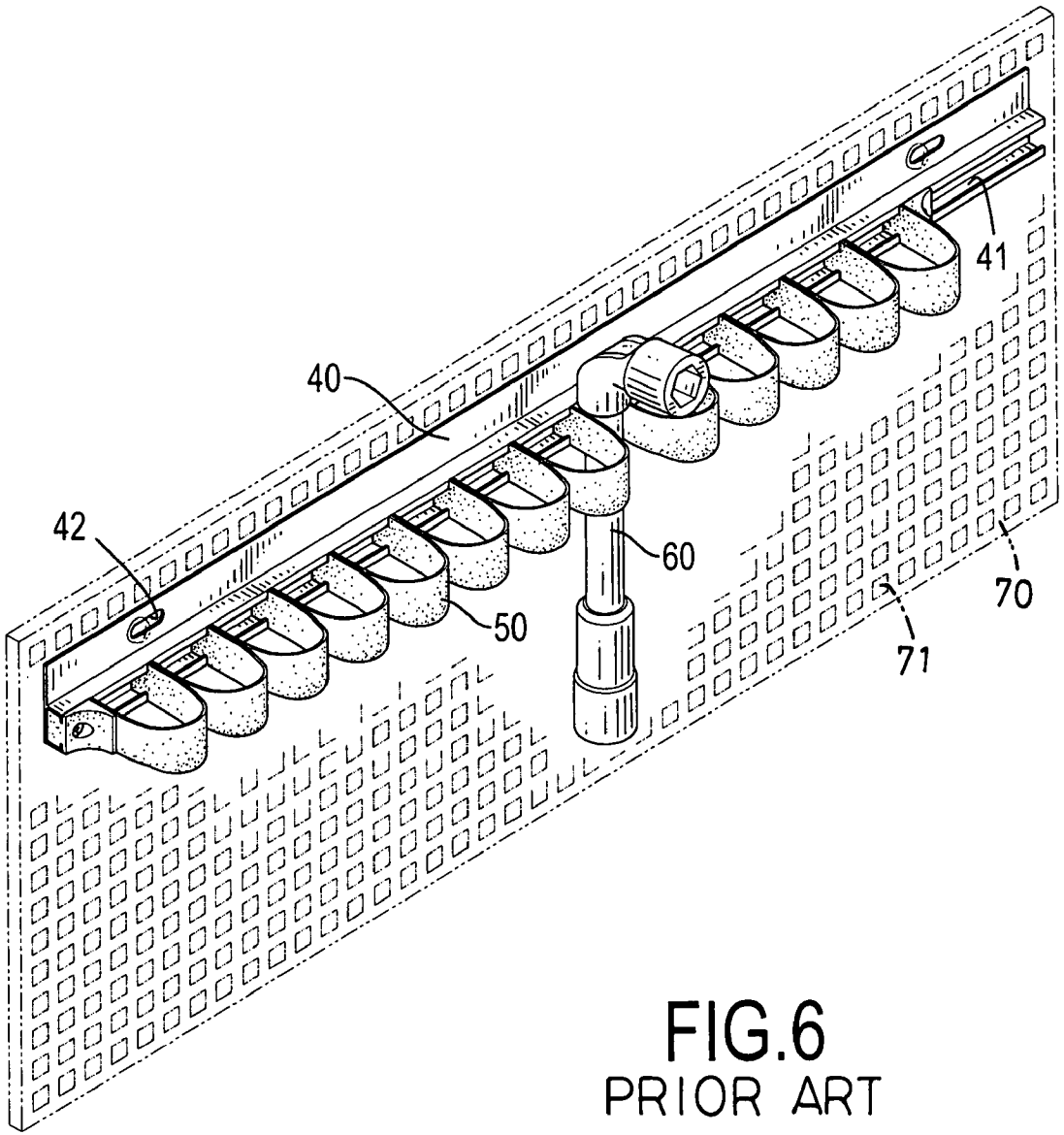
FIG.6 PRIOR ART
FIG. 6 is an operational view of the conventional tool suspension device in FIG. 5 mounted on a perfboard.

With further reference to FIG. 4, the support arm (22) is formed on and extends out from the outside surface of the clamp (21) and has two sides, a distal end, at least one optional jaw (221) and an optional lip (222). The jaw (221) is formed on one side of the support arm (22) and faces a jaw (221) on an adjacent holder (20). The lip (222) is formed on the distal end of the support arm (22).

Figure 3:
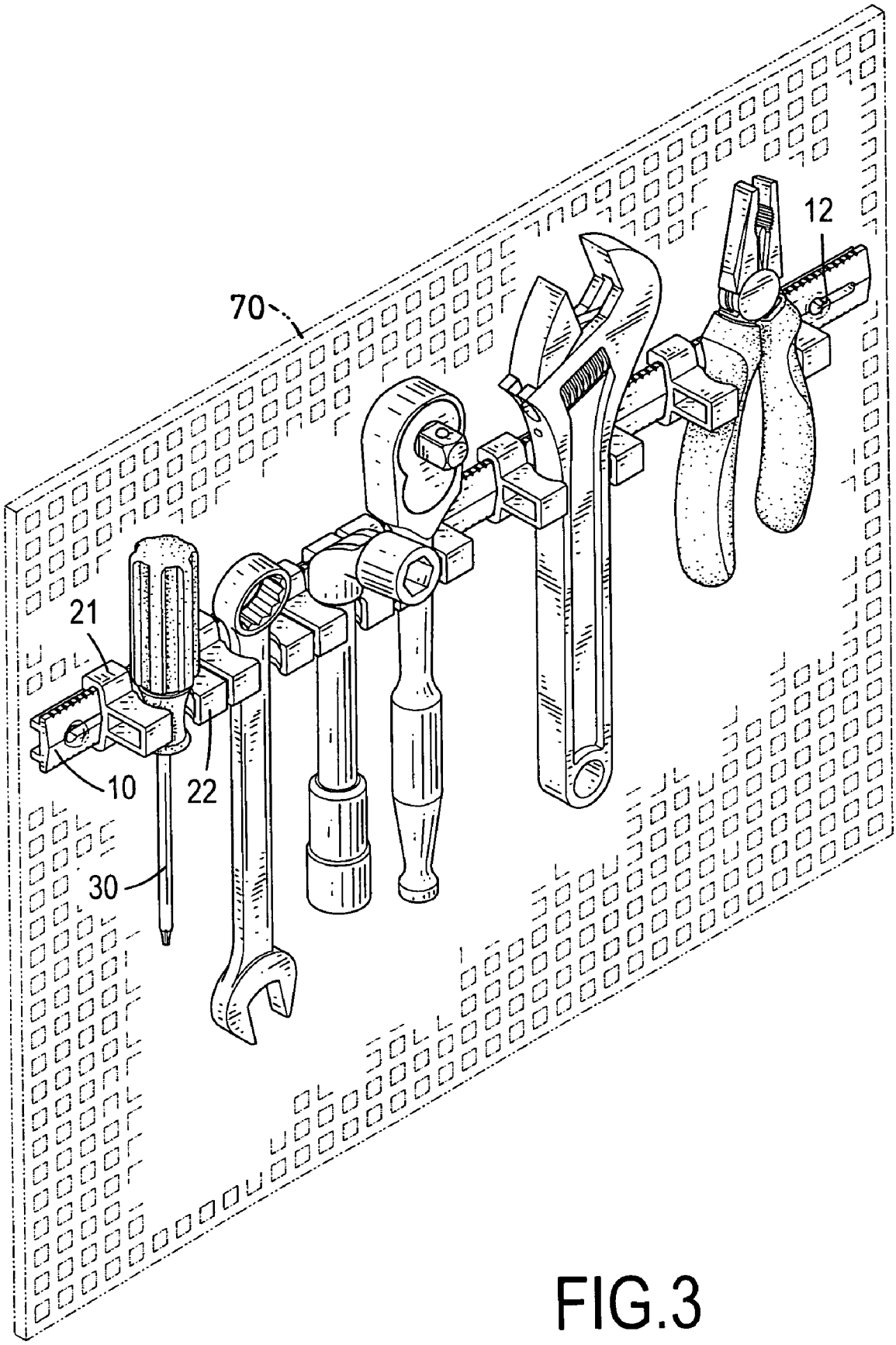
FIG. 3 is an operational perspective view of the tool suspension device in FIG. 1 mounted on a perfboard.

With further reference to FIG. 3, screws pass through the fastening holes (12) and the perfboard (70) to mount the bracket (10) on the perfboard (70). A tool (30) is held between the jaws (221) on adjacent holders (20). Because the holders (20) do not limit the size of the tool (30) held, the tool suspension device as described can hold many and different kinds of tools.

The user adjusts the distance between two holders (20) to hold a specific tool (30). The pawls (213) engage notches in the ratchets (11) to keep the holders (20) in position. When the tool (30) is rotated or lifted a little bit to remove the tool (30), the holders (20) will stay in position because the pawls (213) will not disengage from the notches in the ratchets (11). Replacing a tool (30) between the same adjacent holders (20) does not require the user to adjust the distance between the adjacent holders (20) because the holders (21, 22) are still in position.

To hang a tool (31) with an eye (311), a user simply places the eye (311) over the support arm (22), and the lip (222) will keep the tool (31) from slipping off the support arm (22).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tool suspension device comprising a bracket and first and second holders, the first and second holders being clamped onto the bracket for holding a tool;

the bracket including:

two ends respectably having mounting holes passing through the bracket;

an upper rail extending in a horizontal direction, the upper rail including notches along a length thereof;

a lower rail extending in the horizontal direction, the lower rail including notches along a length thereof; and the first and second holders respectively including:

a clamp having an inside surface and an outside surface;

the inside surface of the clamp including upper and lower grooves; the upper and lower grooves respectively receiving the upper and lower rails of the bracket, the holder sliding along the bracket by cooperation of the upper and lower grooves on the inside surface of the clamp with the upper and lower rails of the bracket;

the upper and lower grooves respectively including at least one pawl with a shape matching the notches along the upper and lower rails of the bracket, the at least one pawl of the upper and lower grooves being received in a corresponding notch of the upper and lower rails of the bracket and holding the holder in a fixed position relative to the bracket, the holder slideably clamping along the bracket; and a support arm extending outwardly from the outside surface of the clamp of the first holder; the support arm including a concave surface facing a concave surface of an adjacent support arm of the second holder and forming a jaw therebetween, the jaw holding the tool that extends vertically in a downward direction.

2. The tool suspension device as claimed in claim 1, wherein the support arm has a distal end extending transversely from the outside surface of the clamp, and a lip is provided on the distal end of the support arm.

* * * * *